US005918459A

United States Patent [19]

Nakae

[11] Patent Number: 5,918,459

[45] Date of Patent: Jul. 6, 1999

[54] ANNULAR TYPE GAS TURBINE COMBUSTOR

[75] Inventor: Tomoyoshi Nakae, Komaki, Japan

[73] Assignee: Mitsubishi Heavy Industries, Ltd,, Tokyo, Japan

[21] Appl. No.: 08/917,466

[22] Filed: Aug. 26, 1997

[30] Foreign Application Priority Data

Sep. 24, 1996 [JP] Japan ..... 8-251443

[51] Int. Cl.[6] ..... F23R 3/26

[52] U.S. Cl. ..... 60/39.23; 60/751

[58] Field of Search ..... 60/39.23, 39.36, 60/748, 751

[56] References Cited

U.S. PATENT DOCUMENTS 2,655,787 10/1953 Brown ..... 60/39.23

3,905,192 9/1975 Pierce et al. ..... 60/39.23

4,202,170 5/1980 Meyer ..... 60/39.23

*Primary Examiner*—Louis J. Casaregola

*Attorney, Agent, or Firm*—Wenderoth, Lind & Ponack, L.L.P.

[57] ABSTRACT

An annular type gas turbine combustor which can regulate air flow distribution without being influenced by high temperature flames and with a desired fuel-air ratio for reducing the generation of $NO_x$ etc. A slide duct (10), for regulating air flow distribution, is disposed slidably in an axial direction at a terminal end of a diffuser (1). And as the slide duct (10) is moved, air flow supplied downstream to a swirler (4) is regulated so as to obtain a desired fuel-air ratio.

10 Claims, 5 Drawing Sheets

ANNULAR TYPE GAS TURBINE COMBUSTOR

BACKGROUND OF THE INVENTION

1. Field of the Invention

The present invention relates to an annular type combustor applied to a gas turbine.

2. Description of the Prior Art

One example of an annular type gas turbine combustor, which is known in the prior art, is described with reference to FIGS. 4 to 6. FIG. 4 is a schematic cross sectional view of a combustor, taken on a vertical plane including a turbine central axis, which shows only an upper half portion of the combustor above the turbine central axis. That is, the annular type combustor forms a combustor which is concentric with respect to the turbine central axis and forms an annulus (like a doughnut shape) surrounding the turbine central axis, together with a lower half portion (not shown) of the combustor turbine below the central axis.

In FIG. 4, numeral 1 designates a diffuser, numeral 2 designates a diffuser case, numeral 3 designates a fuel injector, numeral 4 designates a swirler, numeral 5 designates a liner, numeral 6 designates a dilution hole, numeral 7 designates a cooling hole and numeral 8 designates a rotating ring. In a combustor as so constructed, air passes through the diffuser 1 and enters a combustion region surrounded by the liner 5 via the swirler 4, the dilution hole 6, the cooling hole 7, etc.

In the combustor, the level of $NO_x$ included in an emission gas is influenced by a ratio of fuel to air passing through the swirler 4 (hereinafter referred to as "fuel-air ratio"), and generally as the fuel-air ratio is lowered, the $NO_x$ level becomes lower. Thus, in order to attain a low $NO_x$ level under every operating condition of a gas turbine, there is needed a mechanism for regulating the fuel-air ratio.

In the prior art combustor, therefore, a rotary type flow regulating mechanism, employing the rotating ring 8, at the swirler 4, is provided to change the cross sectional area of the swirler and thus regulate the fuel-air ratio. As shown in FIGS. 5 and 5, the rotating ring 8 has approximately the same structure as the swirler 4 and is constructed with swirling blades, each having a certain thickness. Air flow is regulated by the rotating ring 8 which is rotated so that a relative phase to the swirler 4 is changed.

That is, if the air passage of the rotating ring 8 coincides with the air passage of the swirler 4 at a contact plane, the opening cross sectional area becomes a maximum, and as the relative phase is caused to deviate from this state, as shown in FIG. 6, the opening cross sectional area can be reduced corresponding to the amount of such deviation. According to the change of the opening cross sectional area, the flow rate of air passing through the swirler 4 is increased or decreased with the result that the fuel-air ratio can be regulated.

In the prior art combustor, the rotating ring which is a movable portion for regulating the fuel-air ratio is disposed at a position which is easily influenced by flames, and thus there exists a problem in that the rotating ring is heated to temperatures which will cause the ring to lose its durability and reliability. Also, in such an arrangement, there is a problem in that a complicated mechanism for the movable portion is needed as a countermeasure for thermal expansion etc.

SUMMARY OF THE INVENTION

It is therefore an object of the present invention to provide a highly reliable annular type gas turbine combustor which is able to solve the problems in the prior art with a simple construction and to regulate the fuel-air ratio safely and securely.

In order to attain the object, the present invention provides an annular type gas turbine combustor comprising an air flow distribution regulating device which is disposed at a terminal end of a diffuser and is slidable in an axial direction thereof. Thereby when air supplied downstream from the diffuser passes through the air flow distribution regulating device at the terminal end of the diffuser, the air flow distribution regulating device is slid in the axial direction and distribution of the air flowing downstream is regulated in a desired direction so as to obtain an optimized combustion.

Also, the air flow distribution regulating device is disposed at the terminal end of the diffuser, as mentioned above, which is apart from the flames so as not to be influenced by the flames. Thus, there is no fear of reduced durability due to high temperature flames.

The present invention also provides an annular type gas turbine combustor in which the air flow distribution regulating device is constructed by a plurality of divided objects which are divided in the axial direction. Each of the divided objects is slidable in an axial direction independent of each other, and thus the air flow distribution regulating device which regulates distribution of the air flowing downstream from the diffuser is constructed by a plurality of divided objects which are slidable in the axial direction. Thereby, each of the divided objects can be slid to various sliding patterns so as to effect appropriate regulations to meet operation conditions.

The present invention also provides an annular type gas turbine combustor in which a roller is disposed between the diffuser and the air flow distribution regulating device, and thereby relative movement of the diffuser and the air flow distribution regulating device is achieved smoothly by the effect of rolling of the roller and the distribution of air flow can be regulated securely and easily.

The present invention also provides an annular type gas turbine combustor in which each of the diffuser and the air flow distribution regulating device has a circular cross sectional shape and is disposed concentrically with each other. Thereby, the supplied air flows in a concentrically distributed form and the air flow distribution in the radial direction becomes uniform, so that a regular combustion can be attained.

The present invention also provides an annular type gas turbine combustor in which each of the diffuser and the air flow distribution regulating device has a polygonal cross sectional shape and is disposed concentrically with each other. Thereby, even if the diffuser is formed in a polygonal cross sectional shape, the air flow distribution regulating device can be readily conform to that shape and distribution of air flow can be regulated securely.

The present invention also provides an annular type gas turbine combustor in which the air flow distribution regulating device has its end face formed in a wave shape, and thereby there occurs a differential position in the axial direction between a tip position and a bottom position of the wave shape and making use of said differential position. A flow-out position of the supplied air is caused to change in the axial direction, so that the distribution of air flow in the circumferential direction can be regulated finely.

The present invention also provides an annular type gas turbine combustor in which the air flow distribution regulating device is constructed rotatively around a gas turbine axis. The air flow distribution regulating device is rotated in addition to movement in the axial direction and a fine appropriate regulation of the air flow distribution can be further effected.

DESCRIPTION OF THE PREFERRED EMBODIMENTS

Figure 1:
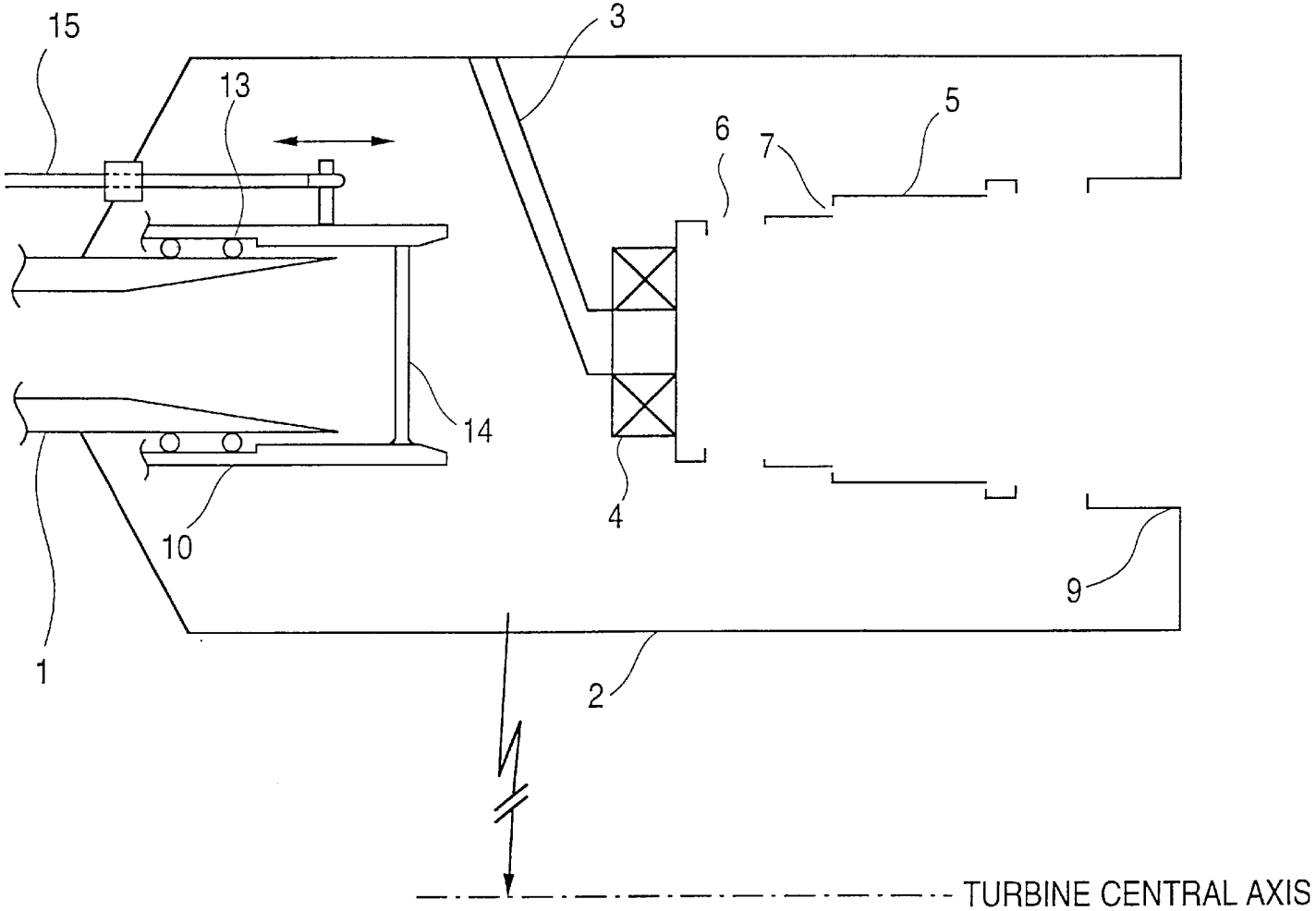
FIG. 1 is a schematic cross sectional view of a combustor of a first embodiment according to the present invention.

A first embodiment according to the present invention is described with reference to FIGS. 1 and 2. It is to be noted that the same portions as those in the above-mentioned prior art are denoted with the same numerals in the figures and characteristic features of the present embodiment are described with repetitive description being omitted.

The air flow distribution regulating device of the present embodiment employs a slide duct 10. The slide duct 10 is concentrically disposed at an end portion of a diffuser 1 so as to surround an outer circumferential surface of the diffuser 1.

Although the figure does not show details, the slide duct 1- is integrally constructed by two divided objects. One object is an outer side portion which is shown in an upper part of FIG. 1 and the other object is an inner side portion shown in a lower part of FIG. 1. A strut 14 is interposed between the two divided objects.

A roller 13 is disposed between the slide duct 10 and the diffuser 1. An actuator 15, which extends outwardly of the combustor and is connected to a portion of the slide duct 10, so that the slide duct 10, when pushed or pulled by the actuator 15, is movable in the axial direction of the diffuser 1.

It is to be noted that the slide duct 10 as shown here is formed of two divided objects, i.e. an upper object and a lower object, as shown in FIG. 1 or an outer object and an inner object with respect to the gas turbine axis. However, the construction is not limited to the two divided objects but can be a single unit or of objects divided into a plurality of more than two in a circumferential direction according to convenience of manufacture.

Further, the integrated slide duct may have a cross sectional shape which is conformable to, and slidable in the axial direction on the diffuser, whether it is circular or polygonal.

Figure 2:
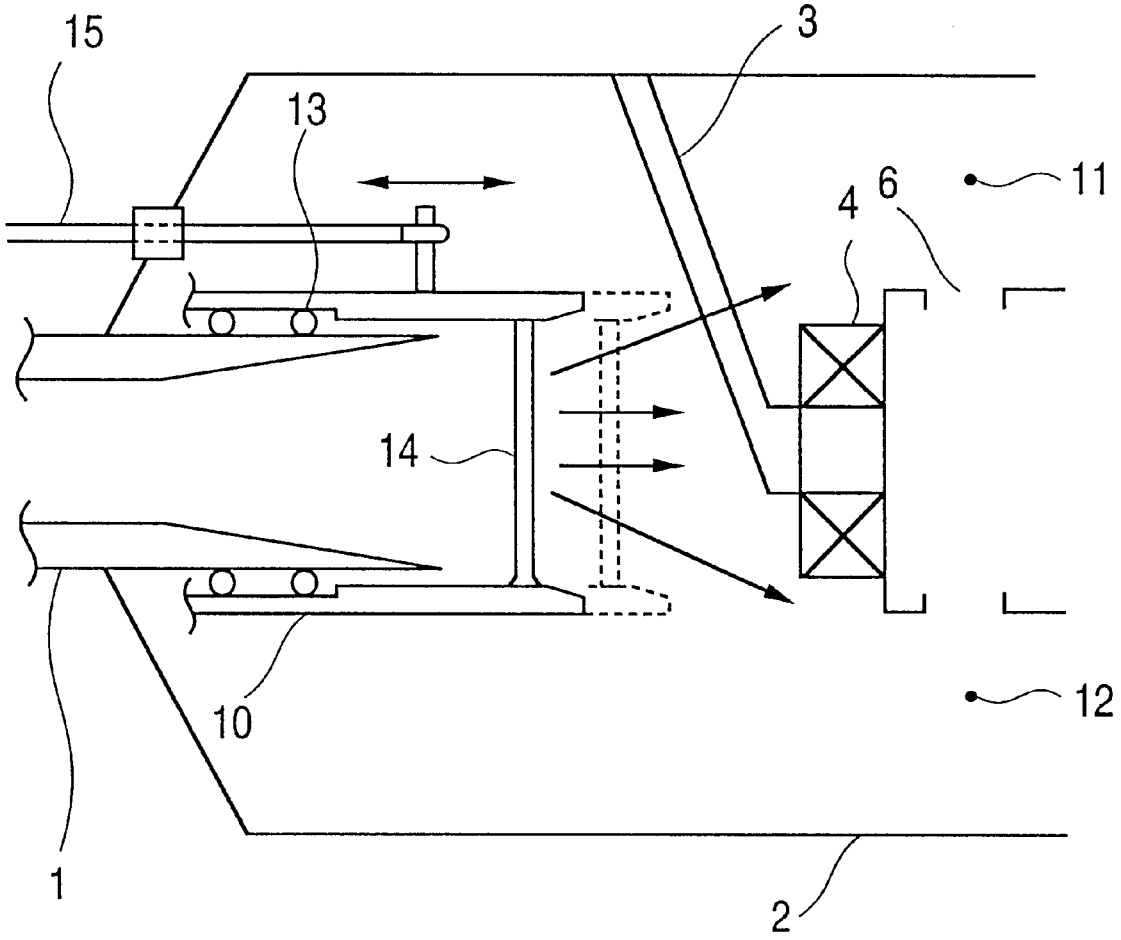
FIG. 2 is an explanatory view of regulation status of the combustor of FIG. 1.

In the present embodiment as so constructed, as shown by broken lines in FIG. 2, if the slide duct 10 is moved to a downstream side (rightwardly in the figure), the flow of air led to the swirler 4 becomes dominated by straight flow components as shown by arrows which extend in parallel to the axial direction. Thus, the amount of air that concentrates toward the swirler 4 increases with the result that the fuel-air ratio becomes lower and $NO_x$ can be reduced, especially at the time of a high load operation.

In contrast thereto, as shown by the solid lines in FIG. 2, if the slide duct 10 is moved in an upstream direction, i.e. to an upstream side (leftwardly in the figure), there is an increase of the air flow components which flow outwardly, as shown by the arrows in a dispensing direction. Thus, the air led to the swirler 4 decreases with the result that the fuel-air ratio becomes higher an instability of combustion at the time of low load operation can be avoided. That is, the air flow distribution in the outward direction and the axial direction changes and the fuel-air ratio becomes higher at the swirler 4 where the air flow distribution decreases.

Figure 3:
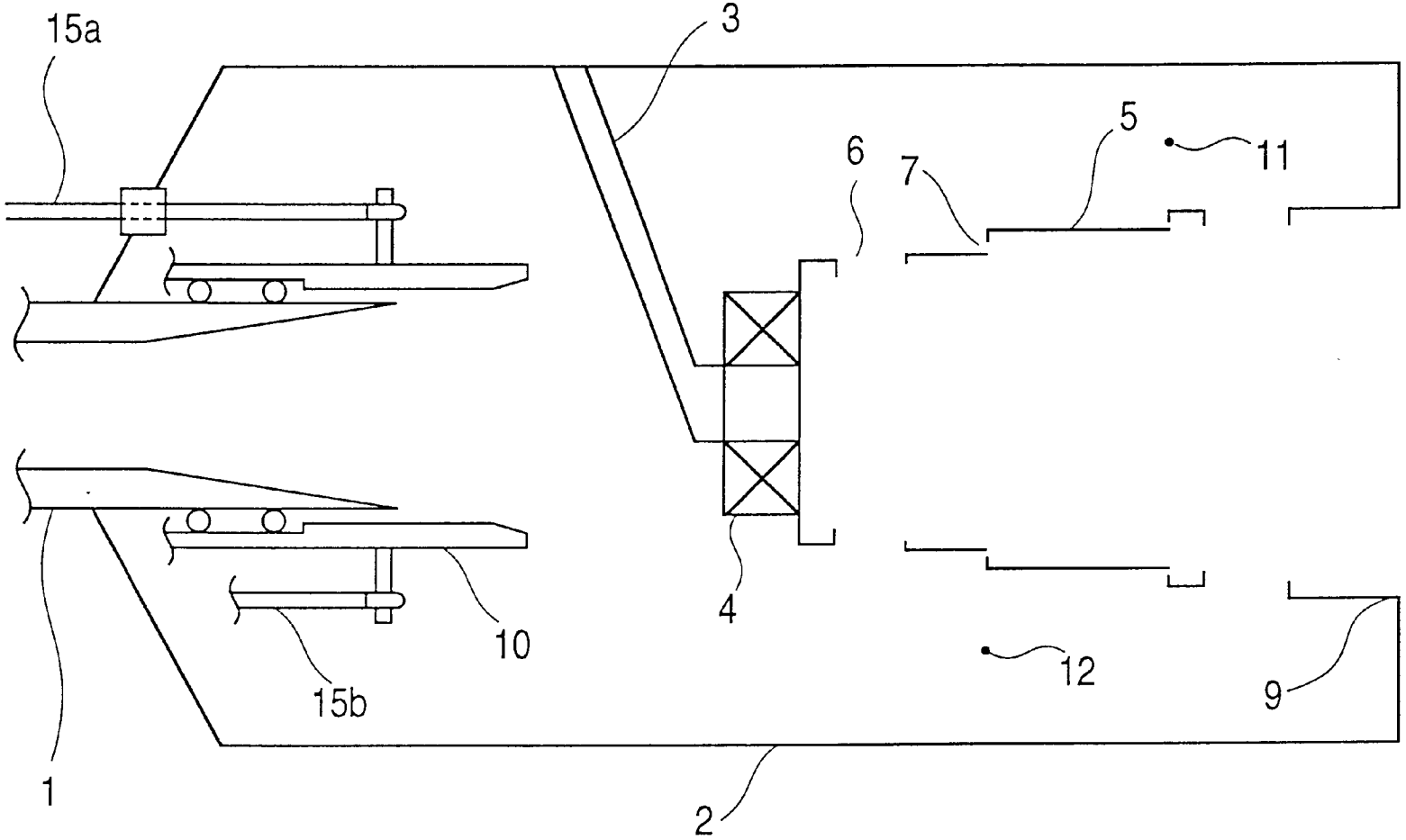
FIG. 3 is a schematic cross sectional view of a combustor of a second embodiment according to the present invention.
Figure 4:
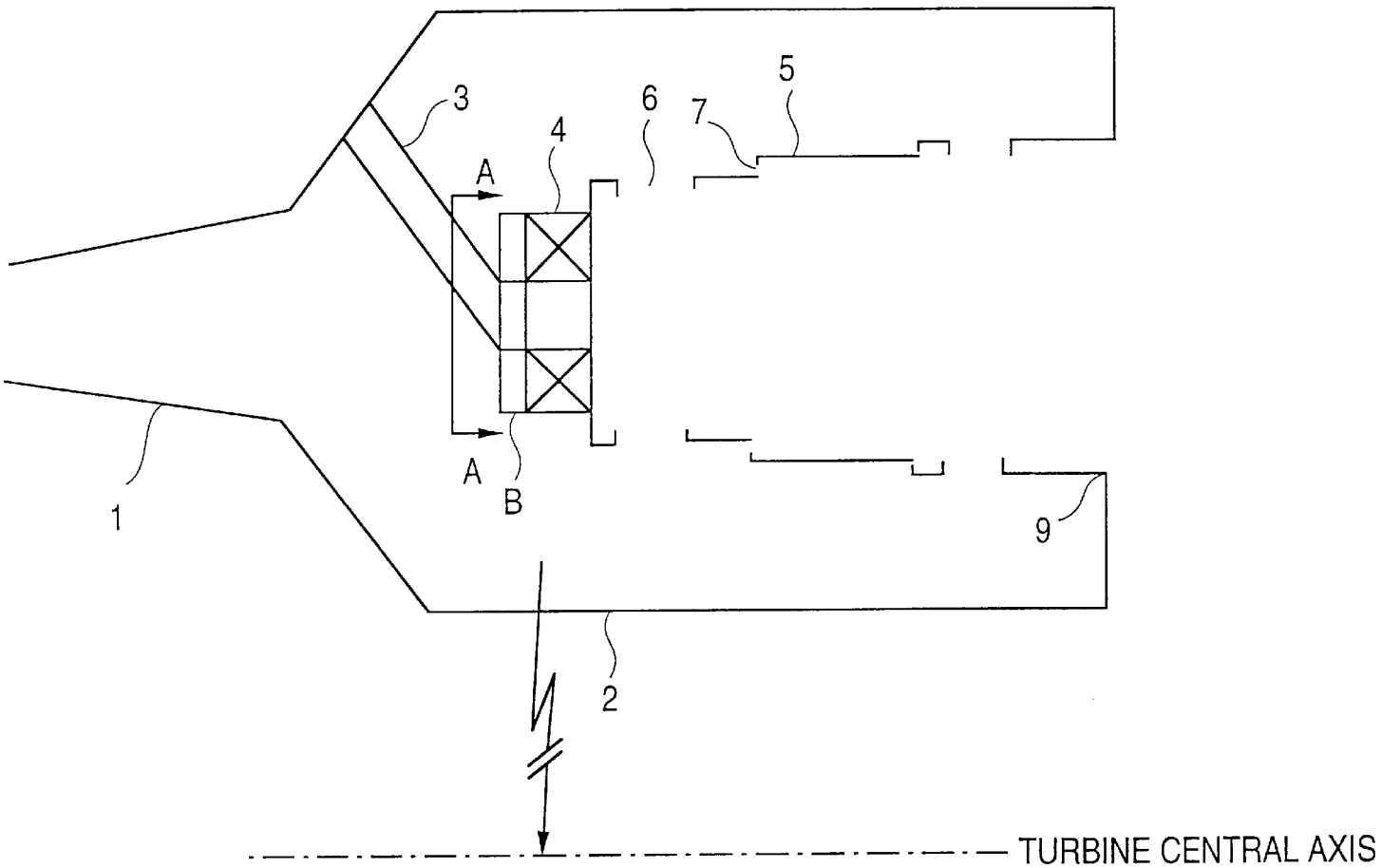
FIG. 4 (PRIOR ART)
FIG. 4 is a schematic cross sectional view of a prior art combustor.
Figure 5:
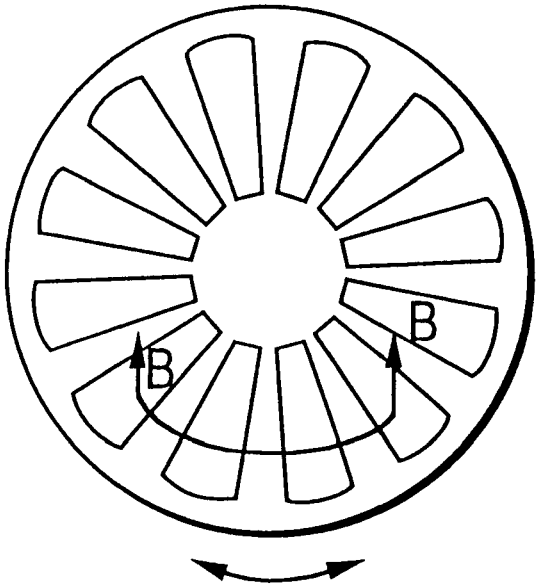
FIG. 5 (PRIOR ART)
FIG. 5 is a cross sectional view taken on line A—A of FIG. 4.
Figure 6:
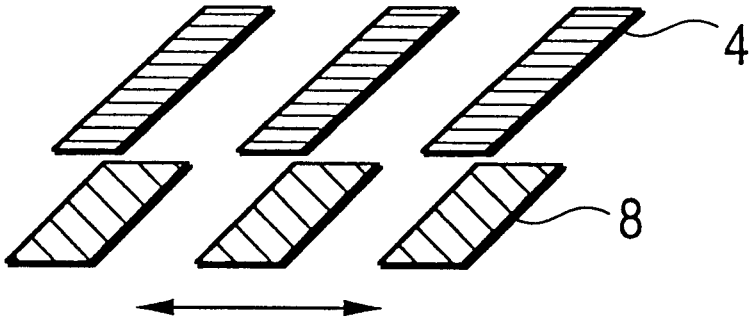
FIG. 6 (PRIOR ART)
FIG. 6 is a cross sectional view taken on line B—B of FIG. 5.

Next, a second embodiment according to the present invention is described with reference to FIG. 3. It is to be noted that same portions as those in the above-mentioned prior art and in the first embodiment are denoted with the same numerals in the figure and repetitive description is omitted.

In an annular type combustor employing a slide duct 10 as an air flow distribution regulating device according to the second embodiment, while the slide duct 10 of the first embodiment is formed by the outer and inner divided objects which are connected by the strut 10, in the second embodiment the strut 10 is removed and the outer and inner slide duct portions are provided with an actuator 15*a*, 15*b*, respectively. With the arrangement illustrated in FIG. 3, each of the slide ducts is independently slide ducts is movable in the axial direction.

In the second embodiment, the outer slide duct and the inner slide duct are moved independently of each other and the distribution of air flow to an outer shroud passage 11 and an inner shroud passage 12 is regulated. Thereby, a ratio of the flow rate of an outer dilution air and an inner dilution air can be changed and a temperature distribution of combustion gas at an outlet portion 9 of the combustor can be optimized.

It is to be noted that although a downstream side end face of the slide duct 10 is flat both in the first and second embodiments, an arbitrary shape of end face, such as uneven wave-shaped end face, for example, can be employed and also it is possible that the air flow distribution can be regulated in a circumferential direction.

Further, if the end face is formed other than in a flat surface, and the slide duct 10 is moved, not only in the axial direction but also rotationally around the gas turbine axis, then a fine and appropriate regulation of air flow distribution can be further effected.

While embodiments of the present invention have been described above with reference to the accompanying figures, the present invention is not limited thereto but may naturally be added with various changes in the disclosed structure within the scope of the appended claims.

According to the present invention, by use of a very simple structure, the air flow distribution regulating device, which is slidable in the axial direction, is disposed at the terminal end of the diffuser, and thus distribution of air flow led to the downstream swirler can be regulated. And by this flow regulation, the fuel-air ratio can also be regulated with the result that the fuel-air ratio is lowered at the time of a high load operation and $NO_x$ can be reduced. Also, at the time of low operation, the fuel-air ratio is enhanced so that stable combustion can be achieved.

Also, the air flow distribution regulating device is disposed in close proximity to the diffuser, and thus it is not influenced by flames. Accordingly, movable portions of the regulating device can be made simpler and an apparatus of high durability and reliability can be provided.

Also, according to the second embodiment of the present invention, the air flow distribution regulating device is constructed by divided objects divided into a plurality and each of the divided objects is arranged so as to be movable independently of each other. Thereby a fine regulation of air flow corresponding to a combustion state becomes possible and a combustion gas temperature distribution at the outlet portion of the combustor can be optimized.

Further, according to the present invention, partial variations, such as a construction in which the roller is disposed between the diffuser and the air flow distribution regulating device, a construction in which the diffuser and the air flow distribution regulating device, each, has a circular or polygonal cross sectional shape and is disposed concentrically with each other, a construction in which the air flow distribution regulating device has its end face formed in a wave-shape, and a construction in which the air flow distribution regulating device is constructed so as to be rotatable around the gas turbine axis, are appropriately selected and added, thereby distribution of supplied air flow can be finely regulated in the axial direction and in the circumferential direction.

I claim:

1. An annular type gas turbine combustor comprising:

a gas turbine combustor casing;

a diffuser connected to an inlet end of said combustor casing, said diffuser having a terminal end;

an air flow distribution regulating device slidably mounted on the terminal end of said diffuser, wherein said air flow distribution regulating device being slidable along an axial direction of said diffuser.

2. An annular type gas turbine combustor as claimed in claim 1, wherein said air flow distribution regulating device comprises a plurality of divided parts which are divided along the axial direction of said diffuser, and each of said divided parts is slidable independently relative to said diffuser.

3. An annular type gas turbine combustor as claimed in claim 2, further comprising a roller disposed between said diffuser and said air flow distribution regulating device.

4. An annular type gas turbine combustor as claimed in claim 3, wherein each of said diffuser and said air flow distribution regulating device has a annular cross sectional shape, and said diffuser and said air flow distribution regulating device are concentric relative to each other.

5. An annular type gas turbine combustor as claimed in claim 2, wherein each of said diffuser and said air flow distribution regulating device has a annular cross sectional shape, and said diffuser and said air flow distribution regulating device are concentric relative to each other.

6. An annular type gas turbine combustor as claimed in claim 1, further comprising a roller disposed between said diffuser and said air flow distribution regulating device.

7. An annular type gas turbine combustor as claimed in claim 6, wherein each of said diffuser and said air flow distribution regulating device has a annular cross sectional shape, and said diffuser and said air flow distribution regulating device are concentric relative to each other.

8. An annular type gas turbine combustor as claimed in claim 1, wherein said air flow distribution regulating device surrounds an outer surface of said diffuser, and a roller is disposed between an inner peripheral surface of said air flow distribution regulating device and an outer peripheral surface of said diffuser.

9. An annular type gas turbine combustor as claimed in claim 1, further comprising an actuator extending through said combustor casing and connected to said air flow distribution regulating device.

10. An annular type gas turbine combustor as claimed in claim 1, wherein said air flow distribution regulating device comprises:

a first part disposed radially outwardly of said diffuser and surrounding an outer peripheral surface of said diffuser;

a second part disposed radially inwardly of said diffuser; and a strut interconnecting said first part and said second parts, wherein said first and second parts and said diffuser are concentrically arranged relative to each other.

* * * * *